US005854187A

United States Patent [19]

Blum et al.

[11] Patent Number: 5,854,187

[45] Date of Patent: Dec. 29, 1998

[54] MICROEMULSION DILUTABLE CLEANER

[75] Inventors: Robert L. Blum, Concord; Michael H. Robbins, Walnut Creek; Lynn M. Hearn; Shona L. Nelson, both of Livermore, all of Calif.

[73] Assignee: The Clorox Company, Oakland, Calif.

[21] Appl. No.: 695,384

[22] Filed: Aug. 9, 1996

[51] Int. Cl.[6] ..... C11D 77/04; C11D 17/00

[52] U.S. Cl. ..... 510/197; 510/238; 510/245; 510/365; 510/417; 510/423; 510/384; 510/463; 510/504

[58] Field of Search ..... 510/197, 238, 510/245, 365, 417, 463, 504, 423, 384

[56] References Cited

U.S. PATENT DOCUMENTS

| | | | |
|---|---|---|---|
| 4,146,499 | 3/1979 | Rosano | 252/186 |
| 4,343,725 | 8/1982 | Kiewert et al. | 252/542 |
| 4,368,147 | 1/1983 | Inamorato et al. | 252/545 |
| 4,414,128 | 11/1983 | Goffinet | 252/111 |
| 4,472,291 | 9/1984 | Rosano | 252/186.28 |
| 4,606,842 | 8/1986 | Keyes et al. | 252/174.23 |
| 4,627,931 | 12/1986 | Malik | 252/153 |
| 4,692,277 | 9/1987 | Sikloski | 252/558 |
| 4,863,629 | 9/1989 | Osberghaus et al. | 252/162 |
| 4,867,898 | 9/1989 | Spaulding et al. | 252/106 |
| 4,880,569 | 11/1989 | Leng et al. | 252/550 |
| 4,921,629 | 5/1990 | Malihi et al. | 252/170 |
| 5,035,826 | 7/1991 | Durbut et al. | 252/121 |
| 5,075,026 | 12/1991 | Loth et al. | 252/122 |
| 5,076,954 | 12/1991 | Loth et al. | 252/122 |
| 5,080,822 | 1/1992 | Van Eenam | 252/170 |
| 5,080,831 | 1/1992 | Van Eenam | 252/558 |
| 5,082,584 | 1/1992 | Loth et al. | 252/122 |
| 5,108,643 | 4/1992 | Loth et al. | 252/174.11 |
| 5,158,710 | 10/1992 | Van Eenam | 252/539 |
| 5,171,475 | 12/1992 | Friesleben | 252/312 |
| 5,290,472 | 3/1994 | Michael | 252/170 |
| 5,336,445 | 8/1994 | Michael et al. | 252/548 |
| 5,393,468 | 2/1995 | Erilli et al. | 252/550 |
| 5,401,325 | 3/1995 | Mihelic et al. | 134/39 |
| 5,401,326 | 3/1995 | Mihelic et al. | 134/40 |
| 5,415,811 | 5/1995 | Wile et al. | 252/546 |
| 5,419,848 | 5/1995 | Van Eenam | 252/164 |
| 5,523,013 | 6/1996 | Durbut et al. | 252/12.1 |
| 5,529,723 | 6/1996 | Drapier | 252/550 |
| 5,538,662 | 7/1996 | Klier et al. | 252/122 |
| 5,543,073 | 8/1996 | Adamy et al. | 510/417 |
| 5,587,357 | 12/1996 | Rhinesmith | 510/417 |
| 5,591,708 | 1/1997 | Richter | 510/463 |
| 5,728,672 | 3/1998 | Richter | 510/463 |

FOREIGN PATENT DOCUMENTS

| | | | |
|---|---|---|---|
| WO 96/38522 | 12/1996 | WIPO | C11D 1/83 |

OTHER PUBLICATIONS

U.S. Patent Application Serial No. 08/452,619, filed May 25, 1995, entitled "Liquid Peracid Precursor Colloidal Dispersions: Microemulsions," Inventors David Scheuing, et al.

*Primary Examiner*—Mukund J. Shah
*Assistant Examiner*—Deepak Rao
*Attorney, Agent, or Firm*—Joel J. Hayashida; Mark E. Baze

[57] ABSTRACT

The invention provides a concentrated, dilutable cleaning composition which comprises a novel microemulsion comprising a nonionic surfactant oil phase, a predominant, aqueous continuous phase, a polar organic solvent coupling agent, and a combination of surfactants different from the surfactant oil phase as the dispersing agent facilitating formation of the microemulsion.

18 Claims, No Drawings

MICROEMULSION DILUTABLE CLEANER

BACKGROUND OF THE INVENTION

1. Field of the Invention

The invention relates to a concentrated, dilutable cleaning composition which comprises a novel microemulsion comprising a surfactant oil phase, an aqueous continuous phase, an organic solvent coupling agent, and a combination of surfactants different from the surfactant oil phase as the dispersing agent facilitating formation of said microemulsion.

2. Brief Statement of the Related Art

Concentrates comprising oil-in-water or water-in-oil microemulsions are well known for providing cleaning concentrates which, upon dilution with water, form a cleaning formulation whose delivery strength is easily adjustable by the user. However, the "oil" phase of such microemulsions has consistently been described as a natural oil, a petroleum distillate (mineral spirit or hydrocarbon), sparingly soluble organic solvent, or a fragrance oil. Examples of these microemulsions include the series of patents to Loth et al., U.S. Pat. Nos. 5,075,026, 5,076,954, 5,082,584 and 5,108,643; to VanEenam, U.S. Pat. Nos. 5,080,822, 5,080,831, 5,158,710 and 5,419,848; to Rosano, U.S. Pat Nos. 4,146,499 and 4,472,291; to Mihelic et al., U.S. Pat. Nos. 5,401,325 and 5,401,326; and the individual patents to Erilli et al., U.S. Pat. No. 5,393,468 and Spaulding et al., U.S. Pat. No. 4,867,898.

However, it has not been heretofore disclosed, taught, or suggested, that one can form a cleaning concentrate comprising an oil-in-water microemulsion wherein the oil phase of such microemulsion is a sparingly soluble nonionic surfactant.

SUMMARY OF THE INVENTION AND OBJECTS

The invention provides a concentrated, dilutable cleaning composition which comprises a novel microemulsion comprising a nonionic surfactant oil phase, a predominant aqueous continuous phase, a polar organic solvent coupling agent, and a combination of surfactants different from the surfactant oil phase as the dispersing agent facilitating formation of said microemulsion.

It is therefore an object of this invention to provide a novel microemulsion concentrated cleaner capable of dilution for use as an all purpose cleaner.

It is a further object of this invention to provide a novel microemulsion cleaner which, upon appropriate dilution with water, forms a milky bloom, or macroemulsion.

It is a still futher object of this invention to provide a novel microemulsion cleaner which uses a sparingly soluble to water insoluble nonionic surfactant as the oil phase, and water as the predominant aqueous continuous phase.

It is a yet further object of this invention to provide a novel microemulsion cleaner which avoids or greatly limits the use of odoriferous solvents, such as fragrance oils, terpenes and tertiary alcohols, as the oil phase. In addition, some of these aforementioned materials are VOC's (volatile organic compounds) and the reduction of these VOC's is highly desirable.

It is another object of this invention to provide a novel microemulsion cleaner which is stable at a variety of temperatures.

It is still another object of this invention to provide a novel microemulsion cleaner which can incorporate a wide variety of fragrances or other limited solubility actives.

It is also an object of this invention to provide a novel microemulsion cleaner which provides enhanced cleaning performance versus a microemulsion cleaner having a solvent as the oil phase.

DETAILED DESCRIPTION OF THE INVENTION

The invention provides a concentrated, dilutable cleaning composition which comprises a novel microemulsion comprising a nonionic surfactant oil phase, a predominant aqueous continuous phase, a polar organic solvent coupling agent, and a combination of surfactants different from the surfactant oil phase as the dispersing agent facilitating formation of said microemulsion.

Standard, additional a djuncts in small amounts such as fragrance, dye, mildewstat/bacteristat and the like can be included to provide desirable attributes of such adjuncts.

In the application, effective amounts are generally those amount s listed as the ranges or levels of ingredients in the descriptions which follow here to. Unless otherwise stated, amounts listed in percentage ("%'s") are in weight percent of the composition, unless otherwise noted.

1. The Oil Phase Nonionic Surfactants

As stated beforehand, the crux of the invention lies in the use of sparingly soluble to water insoluble nonionic surfactants as the oil phase of the invention.

In the invention, the microemulsion is defined as a liquid system in which a sparingly soluble to water insoluble oil phase is dispersed within a continuous liquid phase, which here, is the predom inant aqueous phase. In order to form, and maintain, the microemulsion, a dispersing agent is required, which here, is a combination of surfactants which differ from the sparingly soluble to water insoluble nonionic surfactant. Further, a coupling agent which is a polar organic solvent, is needed to attain appropriate stability of the microemuision.

The microemulsions of the invention a re thermodynamically and temperature stable liquid systems. They are transparent to somewhat translucent at room temperature and are isotropic. They are formed by the gentle admixture of the ingredients and do not require shearing or other addition of energy. However, unlike other microemulsion systems, the inventive microemulsions do not require the use of salt solutions for formation. Additionally, because a nonionic surfactant is used as the oil phase, the inventive microemuisions are more versatile than microemulsions with solvent-based oil phase microemulsions, as the inventive microemulsions more readily disperse or solubilize fragrance oils, or other sparingly soluble materials, without the need of hydrotropes or other dispersants. Further, since the oil phase is a surfactant, greater cleaning efficacy is achieved with the inventive microemulsions.

The novel microemulsions of this invention generally contain a higher active level than is usually necessary for all purpose cleaning, such as the cleaning of various hard surfaces (countertops, floors, walls, tables, etc.). Thus, the formulations of the invention are alternatively referred to as concentrates which are diluted with appropriate amounts of water for use. It is an aesthetic and practical advantage of the inventive microemulsions that, upon attaining a certain use dilution, the microemulsions invert and form macroemusions, producing the classic "bloom" or milky color in the dilution medium. This signals the user that the appropriate concentration or strength (actives level) has been attained for effective cleaning, with minimal residue. Generally speaking, the level of dilution water to microemulsion varies from about 128:1 to 10:1, more preferably about 64:1 to about 10:1, in order to achieve the formation of the macroemulsion or bloom.

The nonionic surfactants used in the oil phase are a sparingly soluble to water insoluble nonionic surfactant having a hydrophile-lipophile balance ("HLB") of less than about 10, more preferably less than about 8. For a futher discussion of HLB measurements, one should consult Popiel, *Introduction to Colloid Science* (1978), pp. 43–44 and Gerhartz, *Ullmann's Encyclopedia of Industrial Chemistry*, 5th Ed., Vol. A9 (1985), pp. 322–23, both of which are incorporated by reference thereto.

The nonionic surfactants are selected from linear and branched alkoxylated alcohols and alkoxylated alkylphenols. The alkoxylated alcohols include ethoxylated, propoxylated, and ethoxylated and propoxylated $C_{5-20}$ alcohols, with about 1–5 moles of ethylene oxide, or about 1–5 moles of propylene oxide, or 1–5 and 1–5 moles of ethylene oxide and propylene oxide, respectively, per mole of alcohol, with the selection of the alkoxylated alcohol being determined according to HLB of less than about 10, more preferably less than about 8. There are a wide variety of products from numerous manufacturers, such as the Neodol series from Texaco Chemical Co., to wit, Neodol 25-3, a linear $C_{12-15}$ alcohol ethoxylate with 3 moles of ethylene oxide ("EO") per mole of alcohol, HLB of 7.8, and Neodol 91-2.5, a linear $C_{9-11}$ alcohol ethoxylate with 2.5 moles of EO; Alfonic 1412-40, a $C_{12-14}$ ethoxylated alcohol with 3 moles of EO from Conoco; Surfonic L12-2.6, a $C_{1O-12}$ ethoxylated alcohol with 3 moles of EO, and Surfonic L24-3, a $C_{12-14}$ ethoxylated alcohol with 3 moles of EO from Huntsman Chemical; and Tergitol 25-L-3, a $C_{12-15}$ ethoxylated alcohol with 3 moles of EO, from Union Carbide. The secondary ethoxylated alcohols include Tergitol 15-S-3, a $C_{11-15}$ secondary ethoxylated alcohol, with 3 moles of EO, from Union Carbide. The branched surfactants, especially preferred of which are tridecyl ethers, include Trycol TDA-3, a tridecyl ether with 3 moles of EO, from Henkel KGaA (formerly, Emery), and Macol TD 3, a tridecyl ether with 3 moles of EO, from PPG Industries. See, also, *McCutcheon's Emulsifiers and Detergents*, 1987. The sparingly soluble nonionic surfactant can also be selected from alkoxylated alkylphenols, such as: Macol NP-4, an ethoxylated nonylphenol with 4 moles of EO, and an HLB of 8.8, from PPG; Triton N-57, an ethoxylated nonylphenol with an HLB of 10.0, Triton N-42, an ethoxylated nonylphenol with an HLB of 9.1, both from Rohm & Haas Co.; and Igepal CO-520, with an HLB of 10.0, an ethoxylated nonylphenol from GAF Chemicals Corp.; Alkasurf NP-5, with an HLB of 10.0, and Alkasurf NP-4, with an HLB of 9.0, both of which are ethoxylated nonylphenols from Alkaril Chemicals; Surfonic N-40, with an HLB of 8.9, an ethoxylated nonylphenol from Huntsman. See, *McCutcheon's Emulsifiers and Detergents* (1987), especially page 282, incorporated herein by reference thereto. The amounts of the oil phase nonionic surfactant are preferably in the range of about 0.1% to about 25%, and most preferably, about 3% to 15%.

2. The Coupling Agent—Solvent

The solvent coupling agent is generally a water soluble or dispersible organic solvent having a vapor pressure of at least 0.001 mm Hg at 25° C. It is preferably selected from $C_{1-6}$ alkanol, $C_{1-6}$ diols, $C_{1-10}$ alkylene glycol ethers, and mixtures thereof. The alkanol can be selected from methanol, ethanol, n-propanol, isopropanol, butanol, pentanol, hexanol, their various positional isomers, and mixtures of the foregoing. It may also be possible to utilize in addition to, or in place of, said alkanols, the diols such as methylene, ethylene, propylene and butylene glycols, and mixtures thereof.

It is preferred to use a straight or branched chain alkanol as the coupling agent of the invention. These are methanol, ethanol, isopropanol, n-propanol, isobutanol, n-butanol, pentanol, hexanol and their positional isomers. Especially preferred is isopropanol, also known as isopropyl alcohol and IPA.

One can also use an alkylene glycol ether solvent in this invention. The alkylene glycol ether solvents are typically in addition to the polar alkanol solvent. They are added to enhance the cleaning performance and work well on greasy or oily soils. These can include ethylene glycol monobutyl ether, ethylene glycol monopropyl ether, propylene glycol n-propyl ether, propylene glycol monobutyl ether, diethylene glycol n-butyl ether, dipropylene glycol methyl ether, dipropylene glycol n-butyl ether (DPNB), and mixtures thereof. Preferred glycol ethers are ethylene glycol monobutyl ether, also known as butoxyethanol, sold as butyl Cellosolve by Union Carbide, and also sold by Dow Chemical Co., 2-(2-butoxyethoxy) ethanol, sold as butyl Carbitol, also by Union Carbide, and dipropylene glycol n-butyl ether, available from a variety of sources. Another preferred alkylene glycol ether is propylene glycol, t-butyl ether, which is commercially sold as Arcosolve PTB, by Arco Chemical Co. The n-butyl ether of propylene glycol is also preferred. Other suppliers of preferred solvents include Union Carbide. It is preferred to limit the total amount of solvent to preferably no more than about 25%, and most preferably, no more than about 15%, of the cleaner. A particularly preferred range is about 1–15%. If any of these organic solvents has a solubility of less than 25% in water (at room temperature, 21° C.), then the amount of such limited water solubility solvents should not exceed about 5%, with the amount of water soluble solvents (such as IPA) then raised to an amount sufficient to maintain the microemulsion. These amounts of solvents are generally referred to as dispersion-effective or solubilizing effective amounts. The solvents, especially the glycol ethers, are also important as cleaning materials on their own, helping to loosen and solubilize greasy soils for easy removal from the surface cleaned.

3. Dispersing Agent—Surfactant Blend

The dispersing agent for the novel microemulsions of the invention is a combination of surfactants different from the oil phase nonionic surfactant. Typically, it is a combination of an anionic and nonionic surfactant which has an HLB above 10. The anionic surfactant is, for example, a linear or branched C6–14 alkylbenzene sulfonate, alkane sulfonate, alkyl sulfate, or generally, a sulfated or sulfonated $C_{6-14}$ surfactant. Pilot L-45, a $C_{11.5}$ alkylbenzene sulfonate (which are referred to as "LAS"), from Pilot Chemical Co., Biosoft S100 and S130 (non-neutralized linear alkylbenzene sulfonic acid, which is referred to as "HLAS") and S40 from Stepan Company; sodium dodecyl sulfate and sodium lauryl sulfate. The preferred anionic surfactant is an acidic HLAS, such as BioSoft S100 or S130, which is neutralized in situ with an alkaline material such as NaOH, KOH, $K_2CO_3$ or $Na_2CO_3$, with more soluble salts being desirable. These acidic surfactants have a higher actives level and are cost-effective. The nonionic surfactant can be chosen from, among others: Alfonic surfactants, sold by Conoco, such as Alfonic 1412-60, a $C_{12-14}$ ethoxylated alcohol with 7 moles of EO; Neodol surfactants, sold by Shell Chemical Company, such as Neodol 25-7, a $C_{12-15}$ ethoxylated alcohol with 7 moles of EO, Neodol 45-7, a $C_{14-15}$ ethoxylated alcohol with 7 moles of EO, Neodol 23-5, a linear $C_{12-13}$ alcohol ethoxylate with 5 moles of EO, HLB of 10.7;

Surfonic surfactants, also sold by Huntsman Chemical Company, such as Surfonic L12-6, a $C_{10-12}$ ethoxylated alcohol with 6 moles of EO and L24-7, a $C_{12-14}$ ethoxylated alcohol with 7 moles of EO; and Tergitol surfactants, both sold by Union Carbide, such as Tergitol 25-L-7, a $C_{12-15}$ ethoxylated alcohol with 7 moles of EO. Macol NP-6, an ethoxylated nonylphenol with 6 moles of EO, and an HLB of 10.8, Macol NP-9.5, an ethoxylated nonylphenol with about 11 moles EO and an HLB of 14.2, Macol NP-9.5, an ethoxylated nonylphenol with about 9.5 moles EO and an HLB of 13.0, both from Mazer Chemicals, Inc.; Triton N-101, an ethoxylated nonylphenol with 9–10 moles of ethylene oxide per mole of alcohol ("EO") having a hydrophile-lipophile balance ("HLB") of 13.4, Triton N-111, an ethoxylated nonylphenol with an HLB of 13.8, both from Rohm & Haas Co.; Igepal CO-530, with an HLB of 10.8, Igepal CO-730, with an HLB of 15.0, Igepal CO-720, with an HLB of 14.2, Igepal CO-710, with an HLB of 13.6, Igepal CO-660, with an HLB of 13.2, Igepal CO-620, with an HLB of 12.6, and Igepal CO-610 with an HLB of 12.2, all polyethoxylated nonylphenols from GAF Chemicals Corp.; Alkasurf NP-6, with an HLB of 11.0, Alkasurf NP-15, with an HLB of 15, Alkasurf NP-12, with an HLB of 13.9, Alkasurf NP-11, with an HLB of 13.8, Alkasurf NP-10, with an HLB of 13.5, Alkasurf NP-9, with an HLB of 13.4, and Alkasurf NP-8, with an HLB of 12.0, all polyethoxylated nonylphenols from Alkaril Chemicals; and Surfonic N-60, with an HLB of 10.9, and Surfonic N-120, with an HLB of 14.1, Surfonic N-102, with an HLB of 13.5, Surfonic N-100, with an HLB of 13.3, Surfonic N-95, with an HLB of 12.9, and Surfonic N-85, with an HLB of 12.4, all polyethoxylated nonylphenols from Huntsman.

The amount of the anionic surfactant is generally between about 0.01 to about 5%, while the second nonionic surfactant should be present at between preferably about 0.05–10%, and generally, less than the oil phase nonionic surfactant. On the other hand, the ratio between the total nonionic surfactants (including the oil phase nonionic surfactant) and the anionic surfactant should be at least greater than 1:1, more preferably between about 15:1 to 1:1.

4. Water

The principal ingredient is water, which should be present at a level of at least about 60%, more preferably at least about 70%, and most preferably, at least about 80%. Deionized water is most preferred. Water forms the predominant, continuous phase in which the oil phase nonionic surfactant is dispersed.

5. Miscellaneous Adjuncts

Small amounts of adjuncts can be added for improving aesthetic qualities of the invention. Aesthetic adjuncts include fragrances, such as those available from Givaudan-Rohre, International Flavors and Fragrances, Firmenich, Norda, Bush Broke and Allen, Quest and others, and dyes and colorants which can be solubilized or suspended in the formulation. Because the microemulsions are clear, colorless liquids, a wide variety of dyes or colorants can be used to impart an aesthetically and commercially pleasing appearance. Also, advantageously, the fragrance oils do not require a dispersant since the oil phase nonionic surfactant will act to disperse limited solubility oils. However, unlike the Loth et al. patents, the fragrance oils do not comprise the majority of the oil phase. This is further advantageous since these aesthetic materials tend to be expensive, so limiting their amount is cost-sparing, and they typically do not add to (and, in fact, may detract from) cleaning performance. The amounts of these aesthetic adjuncts should be in the range of 0–2%, more preferably 0–1%. Additionally, because the surfactants in liquid systems are sometimes subject to attack from microorganisms, it is advantageous to add a mildewstat or bacteristat. Exemplary mildewstats (including non-isothiazolone compounds) include Kathon GC, a 5-chloro-2-methyl-4-isothiazolin-3-one, Kathon ICP, a 2-methyl-4-isothiazolin-3-one, and a blend thereof, and Kathon 886, a 5-chloro-2-methyl-4-isothiazolin-3-one, all available from Rohm and Haas Company; Bronopol, a 2-bromo-2-nitropropane 1,3-diol, from Boots Company Ltd.; Proxel CRL, a propyl-p-hydroxybenzoate, from ICI PLC; Nipasol M, an o-phenyl-phenol, $Na^+$ salt, from Nipa Laboratories Ltd.; Dowicide A, a 1,2-benzoisothiazolin-3-one, from Dow Chemical Co.; and Irgasan DP 200, a 2,4,4'-trichloro-2-hydroxydiphenylether, from Ciba-Geigy A. G. See also, Lewis et al., U.S. Pat. No. 4,252,694 and U.S. Pat. No. 4,105,431, incorporated herein by reference. It is preferred to avoid adjuncts which would result in the suspension of particles in the microemulsion, for example, salts (such as NaCl, $Na_2SO_4$), builders, electrolytes, enzymes, pigments, and the like. This particulate matter may disrupt the microemulsion and reduce the clarity of the resulting product.

In the following Experimental section, the surprising performance benefits of the inventive microemulsion cleaner are demonstrated.

EXPERIMENTAL

In Table I below, a base formulation is disclosed:

TABLE I

| Wt. % | Ingredient | Manufacturer |
|---|---|---|
| 1.0% | $C_{10-12}$LAS | Stepan Biosoft S100 |
| 6.5% | $C_{10-12}$alc. ethox. (2.6 EO) | Huntsman Surfonic L12-2.6 |
| 5.5% | $C_{10-12}$alc. ethox. (6 EO) | Huntsman Surfonic L12-6 |
| 5.0% | IPA | |
| 2.5% | DPNB | Union Carbide |
| q.s. to 100% | D.I. $H_2O$ | |

The above ingredients were assembled and gently admixed, without intensive or extensive shearing. The resulting microemulsion was clear, one phase and stable at room temperature (21.1° C.).

In other tests below, the temperature stability, formation of a bloom (macroemulsion after a certain ratio of water to microemulsion concentrate is achieved) and cleaning performance against standard cleaners is demonstrated.

EXAMPLE II

Temperature Stability Studies

The prototype formulation of Table I was challenged at various temperatures in order to determine the stability of the novel microemulsions. In constant temperature rooms, the products were challenged at temperatures of 1.7° C. (35° F.), 21.1° C. (70° F.), 37.8° C. (100° F.) and 48.8°C. (120° F.). Data pulls took place at 2 weeks, 4 weeks, and 8 weeks for 1.7° C., 21.1° C., 37.8° C. and 48.8° C.; futher data pulls took place at 3 months and 6 months for 1.7° C., 21.1° C. and 37.8° C. At all times and temperatures, the product appeared clear and uncloudy. Additionally, the product formulated as in Table I was subjected to three freeze-thaw cycles and, after appropriate resting from the freeze conditions, similarly appeared clear and uncloudy.

In the following Table II, the prototype formulation of Table I was compared for bloom formation against five commercial microemulsion cleaner products, which were all diluted in accordance with the manufacturer's requirements to the recommended use level (typically, at 1:64 product:

water dilution). A panel of expert visual graders graded the bloom formation on a 0 to 5 scale, with 0 being no bloom, 5 being completely opaque. Thus, the higher the averaged grade, the better. The results are depicted in Table II.

TABLE II

| Bloom Characteristics | | | | |
|---|---|---|---|---|
| | Bloom Characteristic Observed (Visually) | | | |
| Product | 10° C. | 21.1° C. | 37.8° C. | 59.9° C. |
| Formula of Table I | 3 | 4 | 4 | 5 |
| Institutional Pine-Sol ® [1] | 0 | 2 | 3 | 5 |
| Pine-Sol ® [1] | 0 | 0 | 1 | 4 |
| Lysol ® Pine Action[2] | 0 | 0 | 0 | 0 |
| Xtra Pine[3] | 0 | 0 | 0 | 0 |
| Scotch Pine[4] | 0 | 0 | 0 | 0 |

[1]The Clorox Company
[2]Reckitt & Colman
[3]White Cap
[4]Canton Industries

As can be seen from the above data, the inventive formulation consistently produced a bloom, regardless of temperature of the dilution medium (water).

In the next set of experiments, the cleaning performance of the novel microemulsion cleaners was compared against some commercial microemulsion cleaners. The three sets of tests were for kitchen grease #1 (a proprietary fabricated soil containing unsaturated and saturated animal fats and particulate soil), Sanders & Lambert Floor Soil and Bathroom Soil (ASTM). The first two tests were conducted on plastic laminated panels, while the Bathroom Soil was conducted on ceramic tiles. The soiled panels and the soiled tiles were each tested with a Gardner Abrasion Tester whose reciprocating arm was loaded with a moist sponge containing 15 ml. of diluted product (diluted per the manufacturer's use directions). The panels and tiles received 25 strokes of the sponge. A panel of expert graders was again utilized to grade the cleaned panels and tiles, now using a 1 to 10 scale, in which 1 was no soil removal and 10 was complete soil removal. Thus, the higher the averaged grade, the better. The results are depicted in Table III:

TABLE III

| Cleaning Performance | | | |
|---|---|---|---|
| | Soil Removal under Recommended Use Dilutions | | |
| Product | Kitchen Grease #1 | Sanders & Lambert Soil | Bathroom Soil |
| Formula of Table I | 6.3 | 7.47 | 7.13 |
| Pine-Sol ® | 6.67 | 6.8 | 6.18 |
| Lysol ® Pine Action | 2.55 | 5.85 | 4.67 |
| Xtra Pine | 3.07 | 4.12 | 4.02 |
| Lemon Fresh Pine-Sol ® [1] | 4.07 | 4.9 | 4.55 |
| LSD | 1.79 | 0.83 | 0.85 |

[1]The Clorox Company

As can be seen from the foregoing data, the inventive microemulsion, in use dilution, provided superior cleaning performance against most of the commercial microemulsions. This shows that the inventive microemulsions, which have an entirely different chemical structure, provide unobvious performance benefits.

We claim:

1. A concentrated, dilutable cleaning composition which comprises a microemulsion comprising a nonionic surfactant oil phase, a predominant, aqueous continuous phase, a polar organic solvent coupling agent, and a combination of surfactants different from the surfactant oil phase as the dispersing agent facilitating formation of said microemulsion, said cleaning composition characterized by exhibiting the feature of blooming upon dilution with water in the absence of a lipophilic oil other than a nonionic surfactant.

2. The cleaning composition of claim 1 wherein said nonionic surfactant oil phase has an HLB of less than about 10.

3. The cleaning composition of claim 1 wherein said polar organic solvent has a vapor pressure of at least 0.001 mm Hg at 25° C.

4. The cleaning composition of claim 3 wherein said polar organic solvent is selected from the group consisting of $C_{1-6}$ alkanol, $C_{1-6}$ diols, $C_{1-10}$ glycol ethers, and mixtures thereof.

5. The cleaning composition of claim 1 wherein said nonionic surfactant oil phase is selected from the group consisting of alkoxylated alcohols and alkoxylated alkylphenols.

6. The cleaning composition of claim 1 wherein at least one of said combination of surfactants is a nonionic surfactant having an HLB of greater than 10.

7. The cleaning composition of claim 1 wherein at least one of said combination of surfactants is an anionic surfactant.

8. The cleaning composition of claim 1, which further comprises at least one nonessential adjunct selected from the group consisting of fragrances, dyes, colorants, mildewstats and bacteristats.

9. A concentrated, dilutable cleaning composition of a clear microemulsion comprising:

a. an oil phase consisting essentially of a nonionic surfactant, said oil phase dispersed in a predominant, aqueous continuous phase;

b. at least one polar organic solvent coupling agent; and c. at least two additional surfactants different from the surfactant of said oil phase, said additional surfactants being the dispersing agent facilitating formation of said microemulsion, said cleaning composition characterized by exhibiting the feature of blooming upon dilution with water in the absence of a lipophilic oil other than a nonionic surfactant.

10. The cleaning composition of claim 9 wherein the nonionic surfactant is selected from the group consisting of alkoxylated alcohols and alkoxylated alkylphenols.

11. The cleaning composition of claim 9 wherein said at least one polar organic solvent comprises a first such solvent selected from the group consisting of $C_{1-6}$ alkanols and $C_{1-6}$ diols, and a second such solvent of a polar glycol ether.

12. The cleaning composition of claim 9 wherein at least one of said additional surfactants is an anionic surfactant.

13. The cleaning composition of claim 9 wherein said additional surfactants include an anionic surfactant and a nonionic surfactant.

14. The cleaning composition of claim 9 which futher comprises at least one nonessential adjunct selected from the group consisting of fragrances, dyes, colorants, mildewstats and bacteristats.

15. A concentrated, dilutable cleaning composition of a clear microemulsion comprising:

a. at least about 60% wt. water, said water being part of a predominant aqueous continuous phase;

b. about 0.1–25% wt. of a first nonionic surfactant with an HLB of less than about 10, said first nonionic surfactant effectively constituting a sparingly soluble to essentially water insoluble oil phase;

c. about 0.01–5% wt. of an anionic surfactant;

d. about 0.05–10% wt. of a second nonionic surfactant having an HLB of greater than 10, the ratio of the total of the first and second nonionic surfactants to the anionic surfactant at least greater than 1:1, the anionic surfactant and the second nonionic surfactant being a dispersing agent for the first nonionic surfactant oil phase; and e. about 0–25% of a coupling agent comprising a polar organic solvent, said cleaning composition characterized by exhibiting the feature of blooming upon dilution with water in the absence of a lipophilic oil other than a nonionic surfactant.

16. The cleaning composition of claim 15 wherein at least one of said first and second nonionic surfactants is selected from the group consisting of alkoxylated alcohols and alkoxylated alkylphenols.

17. The cleaning composition of claim 15 wherein said polar organic solvent is selected from the group consisting of $C_{1-6}$ alkanols, $C_{1-6}$ diols, polar glycol ethers, and mixtures thereof.

18. The cleaning composition of claim 15 which further comprises at least one nonessential adjunct selected from the group consisting of fragrances, dyes, colorants, mildewstats and bacteristats.

* * * * *